US006738989B2

(12) United States Patent
Harbutt et al.

(10) Patent No.: US 6,738,989 B2
(45) Date of Patent: May 25, 2004

(54) DISPENSER FOR USE IN A TANK OF WATER

(75) Inventors: Richard P. Harbutt, Old Windsor (GB); David C. Snow, Gloucester (GB); Peter T. M. Nott, Somerset (GB); Simon M. Conway, Burlington, WI (US); Kevin Harrity, Oak Creek, WI (US); Steven A. Zach, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/163,931

(22) Filed: Jun. 5, 2002

(65) Prior Publication Data

US 2003/0226198 A1 Dec. 11, 2003

(51) Int. Cl.[7] ..... E03D 9/02

(52) U.S. Cl. ..... 4/227.1; 4/227.2; 4/227.3; 4/227.4

(58) Field of Search ..... 4/227.1–227.4, 4/223, 224; 222/67, 181.3, 306, 363, 366

(56) References Cited

U.S. PATENT DOCUMENTS

| | | | | |
|---|---|---|---|---|
| 2,587,388 A | | 2/1952 | Ryder, Jr. | |
| 2,647,266 A | | 8/1953 | Vierra | 4/227 |
| 2,726,406 A | | 12/1955 | Vierra | 4/228 |
| 2,798,230 A | | 7/1957 | Le Febvre et al. | 4/227 |
| 2,913,734 A | * | 11/1959 | O'hare | 4/227.3 |
| 3,023,426 A | | 3/1962 | Neal | 4/228 |
| 3,545,014 A | | 12/1970 | Davis | |
| 3,698,021 A | | 10/1972 | Mack et al. | |
| 3,841,524 A | | 10/1974 | Easter | |
| 3,874,007 A | | 4/1975 | Dolan | |
| 3,883,024 A | | 5/1975 | Thomas | |
| 4,101,043 A | | 7/1978 | Johnson, Jr. et al. | |
| 4,189,798 A | | 2/1980 | Williamson et al. | |
| 4,261,957 A | * | 4/1981 | Schimanski | 4/227.1 |
| 4,285,074 A | | 8/1981 | Leinberry | |
| 4,346,483 A | | 8/1982 | Rosen et al. | |
| 4,436,269 A | | 3/1984 | Dirksing et al. | |
| 4,534,071 A | | 8/1985 | Russomanno | |
| 4,660,231 A | | 4/1987 | McElfresh et al. | |
| 4,696,414 A | | 9/1987 | Huat | |
| 4,915,260 A | | 4/1990 | Jones | |
| 4,916,760 A | | 4/1990 | Shahar | |
| 5,038,417 A | | 8/1991 | Bavaveas | |
| 5,488,742 A | | 2/1996 | Liao | |
| 5,551,095 A | | 9/1996 | Chen | |
| 5,903,930 A | | 5/1999 | Huang | |
| 5,924,142 A | | 7/1999 | Wang | |

FOREIGN PATENT DOCUMENTS

| | | | |
|---|---|---|---|
| EP | 1026331 | 8/2000 | |
| GB | 2167041 | 5/1986 | |
| WO | WO 01/88287 A1 | 11/2001 | E03D/9/03 |

* cited by examiner

*Primary Examiner*—Tuan N. Nguyen

(57) ABSTRACT

A dispenser for use in a toilet tank is disclosed. There is a replaceable bottle There is also an upwardly open holster for receiving the bottle in inverted fashion. A valve is associated with the holster that controls the dispensing of cleaner from the container, and/or a mounting hook is provided on the holster that can pivot between a storage position in a bottle recess and a mounting position snap locked on the holster (or is integrally linked to the holster).

13 Claims, 4 Drawing Sheets

DISPENSER FOR USE IN A TANK OF WATER

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

This invention relates to dispensers used in bodies of water where the water level rises and falls. It is particularly well suited to dispense cleaning and/or freshening chemicals into such bodies of water, to thereby clean such tanks (or containers downstream there from such as a toilet bowl) which hold the treated water.

A variety of dispensers exists for automatically dispensing one or more chemicals into a water tank. These often have a hook mechanism which hangs the dispenser from the top of a tank wall under the lid, with a portion of the dispenser suspended in the tank water when the tank is filled. See e.g. U.S. Pat. Nos. 5,924,142; 5,903,930; 5,551,095; 5,038,417; 4,916,760; 4,915,260; 4,696,414; 4,660,231; 4,534,071; 4,436,269; 4,346,483; 4,285,074; 4,189,793; 4,101,043; 3,883,024; 3,874,007; 3,841,524; 3,698,021; 3,545,014 and 2,587,388. See also GB 2,167,041 and EP 1,026,331. The disclosure of these patents and of all other publications referred to herein are incorporated by reference as if fully set forth herein.

For example, U.S. Pat. No. 5,488,742 discloses a toilet tank dispenser hangable by a U-shaped bracket from a toilet tank wall. The bracket supports an upwardly open cup that can receive an inverted disinfectant container. The container has a mouth sealed by a pierceable foil membrane that is pierced open by a projection housed near a lower portion of the cup. However, the cup does not sufficiently envelop the bottle to provide secure support or assurance of an air pathway to vent the bottle. Moreover, the bottle is somewhat difficult to remove. Further, the mounting hook is somewhat awkward to use.

U.S. Pat. No. 3,888,024 describes the desirability of a type of pivotal hanger that can be compactly stored during shipment and pivoted out to a locked position. However, it does not describe a system for automatically moving the hanger to a operational position simply by removing a bottle.

A variety of bottles are known which have integral side or top handles formed by a through hole in the container. However, Applicants are not aware of a bottle provided with a through handle adjacent a base, much less such a structure with an adjacent cut out for accommodating hook storage. Such a bottle would have been assumed to have too high of a center of gravity, and thus have a propensity to tip.

Accordingly, there is a need in the art for an improved dispenser.

SUMMARY OF THE INVENTION

In one aspect the invention provides a dispenser for use in a tank that has a liquid level that rises and falls (e.g. water in a toilet tank). There is a container having a bottom, side walls, a top, an upper outlet, and an internal cavity. There is also an upwardly open holster for receiving the container with the container in an inverted position so that the upper outlet of the container is inside the holster, and so that a majority of the outside surface area of the side walls of the container is inside the holster. It is desirable that the container contains a dispensable product (e.g. a toilet bowl cleaner; a disinfectant).

In especially preferred forms there is a valve associated with the holster for controlling the dispensing of the dispensable product from the container in response to liquid level changes in the tank. The valve can have an air passage for permitting air to vent the container as the dispensable product is dispensed, and/or a piercing post extending upwardly. Where there is a piercing post, the container will have at least a portion of a pierceable membrane associated with the upper outlet of the container.

The enveloping nature of the holster helps insure that the fill level of the tank will be below the top of the holster, thereby preserving an air passageway to vent the bottle. Further, the enveloping nature of the holster inhibits the bottle from being accidentally knocked off the dispenser unit.

During storage and shipment the mouth of the bottle can be sealed with a foil seal. Thereafter, a protective cap can be removed, and the mouth of the bottle can be driven down against the piercing post to break open the seal of the bottle. This helps avoid spills when the bottle is inserted.

In another aspect the invention provides a dispenser for use in a tank that has a liquid level that rises and falls, albeit where a particular hook mechanism is provided (regardless of the degree of enveloping of the holster). In this embodiment the container also has a recess in a side wall adjacent its bottom. There is a hook linked to the holster suitable to mount the dispenser on a tank wall such that the hook is pivotally mounted on an essentially horizontal axis to move from a first position overlying a portion of the container adjacent the recess to a second position outward of the container. Upward movement of the container while removing the container from the holster can drive the hook from the first position to the second position. This construction provides a compact configuration for shipment in which the hook can be mounted in its locked installed position simply by removing the container from the holster.

In this regard, if desired, the hook can have laterally projecting tabs, and the holster can have a slot adjacent its upper end. Where these structures are provided pivoting of the hook from the first position to the second position can drive the projecting tabs into snap engagement with sides of the slot. This provides a secure interlock to fix the hook in the second position.

Given that in a preferred form the holster envelops most of the bottle, absent other modifications as described below, it would be difficult to obtain a good grip on the bottle to remove it, particularly if humidity in the tank has caused condensation on the bottle sides. Thus, in another aspect of the invention a specialized bottle is provided.

In this regard, the bottle can have a housing with a bottom, side walls, a top, an internal cavity suitable to contain a dispensable product, an outlet adjacent the top of the bottle connected to the cavity, and a through passageway extending between opposed side walls adjacent, but not at, the bottom. Such a structure would be thought to have too high a center of gravity to be a desirable structure (due to tipping concerns). However, given the present application where the normal use is in an inverted position, this is not of concern.

In a preferred form the bottle passageway can have at least two lobes to facilitate gripping of the bottle by two fingers extended through the bottle passageway.

The bottle container can be made of an essentially rigid plastic. The preferred product placed in the container is a cleaning agent selected from the group consisting of liquid or flowable gel. For toilet bowl cleaners, a variety of the known flowable concentrated toilet bowl cleaning materials currently recommended for use in toilet tank water can be used, or others can be developed using surfactants, dyes, fragrances and/or other cleaning agents such as acids and chelating agents. For swimming pools, known flowable pool cleaning and/or water treatment chemicals can be used.

In yet another aspect the invention provides such a dispenser (regardless of degree of enveloping of the holster) where the side walls of the container and internal walls of the holster have compatible sloping to permit guided nesting of the two. If desired, instead of a pivotable hook the hook can be integrally formed with the holster in a fashion suitable to permit the mounting of the holster on a toilet tank wall at a defined distance below the top of the tank wall. This embodiment has the advantage of insuring proper alignment of the bottle relative to the piercing and venting structures. Further, it provides assurance to the consumer that the dispenser will be mounted at a correct height (e.g. too high a height does not allow the float valve to function properly; too low a mounting may let tank water spill into the holster).

A better understanding of these and other features and advantages of the present invention can be had by reference to the drawings and to the accompanying description, in which there are illustrated and described preferred embodiments of the invention.

DESCRIPTION OF THE PREFERRED EMBODIMENT

Figure 2:
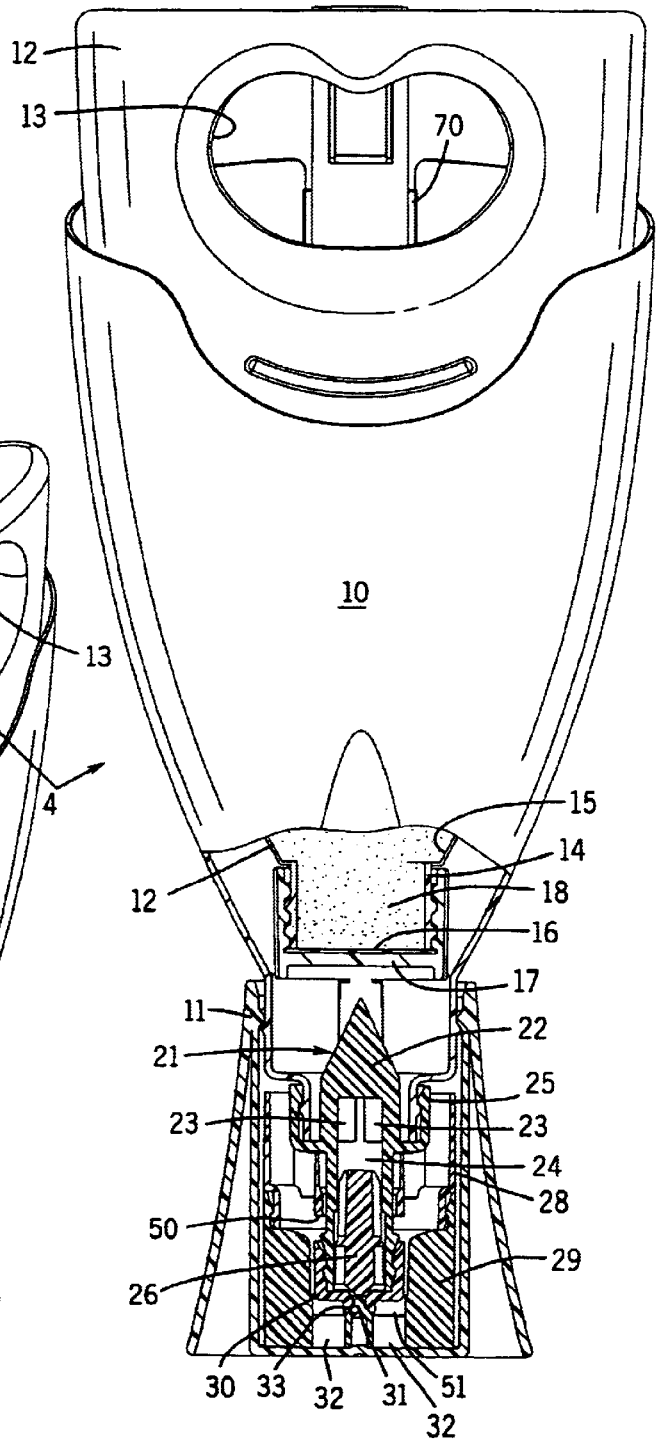
FIG. 2 is a front elevational view, partially in section, of the FIG. 1 device.
Figure 1:
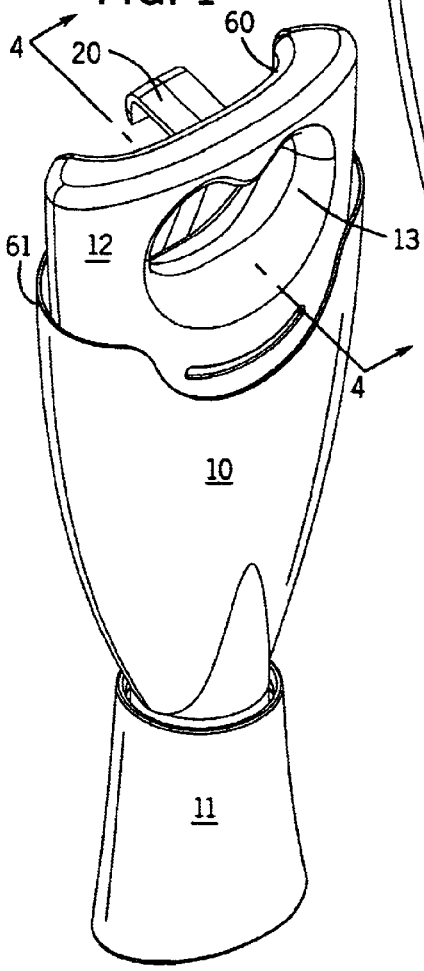
FIG. 1 is a perspective view of an in-tank dispenser according to the present invention.

FIGS. 1 and 2 depict a holster 10, a stand 11, and a removable bottle 12. The bottle has a through passage 13 to provide a hand grip area and a mouth 14. There is a hollow cavity 15 inside the bottle that can be filled with a selected chemical cleaner.

For shipment a pierceable aluminum foil seal 16 is adhered to the mouth of the bottle, and a cap 17 removably closes the bottle via the usual threads. The holster 10 is provided with a hook 20 for mounting on a toilet tank wall (not shown) or the like.

There is also a control mechanism having an adaptor (generally 21) that has a piercing member 22 with an upper pointed portion, side openings 23 and a central axial bore 24. Collar 25 is designed to snap onto a lower end of the holster 10.

Shuttle 26 is inserted in the central axial bore 24. A first float part 28 is then positioned around the central section of the piercing member. A cap 30 snaps onto the bottom of the piercing member to trap the first float part. A second float part 29 is then snapped onto the first float part 28. The second float part 29 has a valve head 31 as well as a passageway 32 beneath it that can be reached when the head is not sealing an outlet hole 33 in the cap 30.

The product is purchased in the form shown in FIG. 1. A consumer snaps off the protective stand 11, temporarily removes the bottle 12 from its holster, screws off the cap 17, gently replaces the cup-less bottle in the holster, and hangs the assembly on a tank wall.

The consumer then pushes down on the bottle, causing the piercing post 22 to pierce the seal 16, permitting the cleaning product to drain downward into side openings 23 and then into bore 24. Because the specific gravity of the cleaner liquid is greater than that of the shuttle 26, the shuttle will float upward in the bore 24, until it essentially closes off the side openings 23. However, at this point the cleaner cannot exit the dispenser as the head 31 is sealing off the outlet hole 33. In this regard, the float assembly 28, 29 is driven up by water to make a secure seal between elements 31 and 33.

When a flush cycle is initiated, the float assembly drops with the water until edge 50 of float part 28 rests against the top of cap 30. At this point, the head 31 no longer seals outlet hole 33. Cleaner can then drain out of the bore 24 into the reservoir 51. It can then pass by an outlet to passageway 32 and into the tank water.

However, as this is happening the shuttle 26 drops to the bottom of the bore 24 so that a pointed portion of the shuttle seals off the outlet hole 33 from its top end. Air in the tank can now access the bottle via the gap between the float part 28 and the holster 10, to vent the bottle interior. Thus, regardless of how quickly the tank is refilled, only a single measured aliquot of cleaner will be dispensed during the down stroke of each flush.

When the tank refills the head 31 seals the outlet 33 from the bottom and slightly pokes the shuttle up. This permits a bleed of product that is above the shuttle to continue past and under the shuttle 26. The shuttle then floats up to its original position for the next cycle.

The bottle 12 and holster 10 of this invention are formed from a durable material capable of withstanding prolonged immersion in water, and also capable of resisting the corrosive effects of the product it dispenses, such as polypropylene and/or acrylic. The cleaning and/or freshening agent according to the preferred embodiment is preferably a fluid, most preferably a liquid or a gel, and preferably has a viscosity of less than about 100 centipoise, more preferably less than about 30 centipoise, most preferably less than about 10 centipoise. The viscosity is greater than 0 centipoise.

Figure 4:
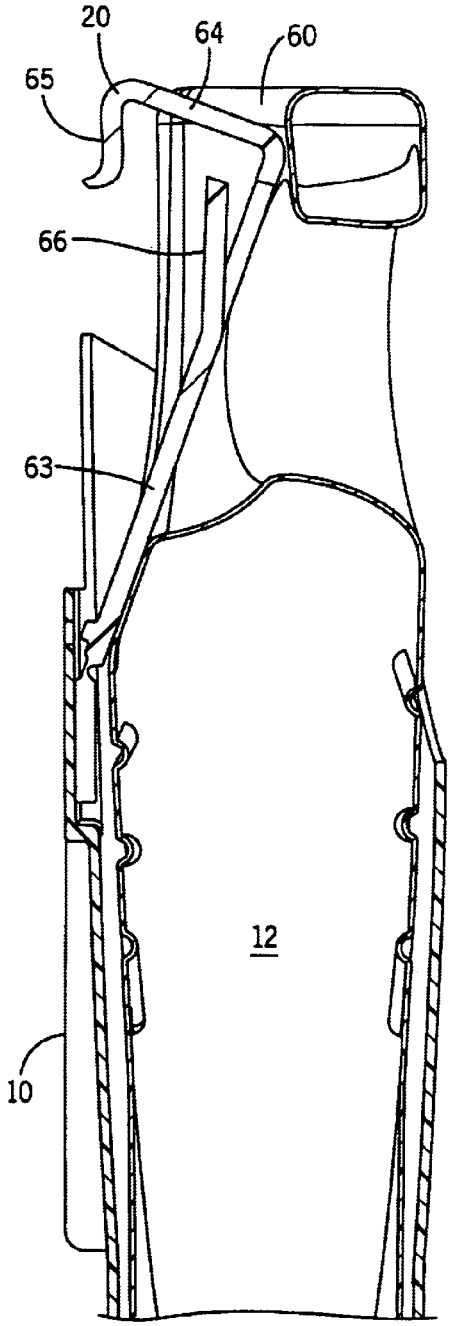
FIG. 4 is a view, partially in vertical section, of the upper portion of the FIG. 1 device.
Figure 5:
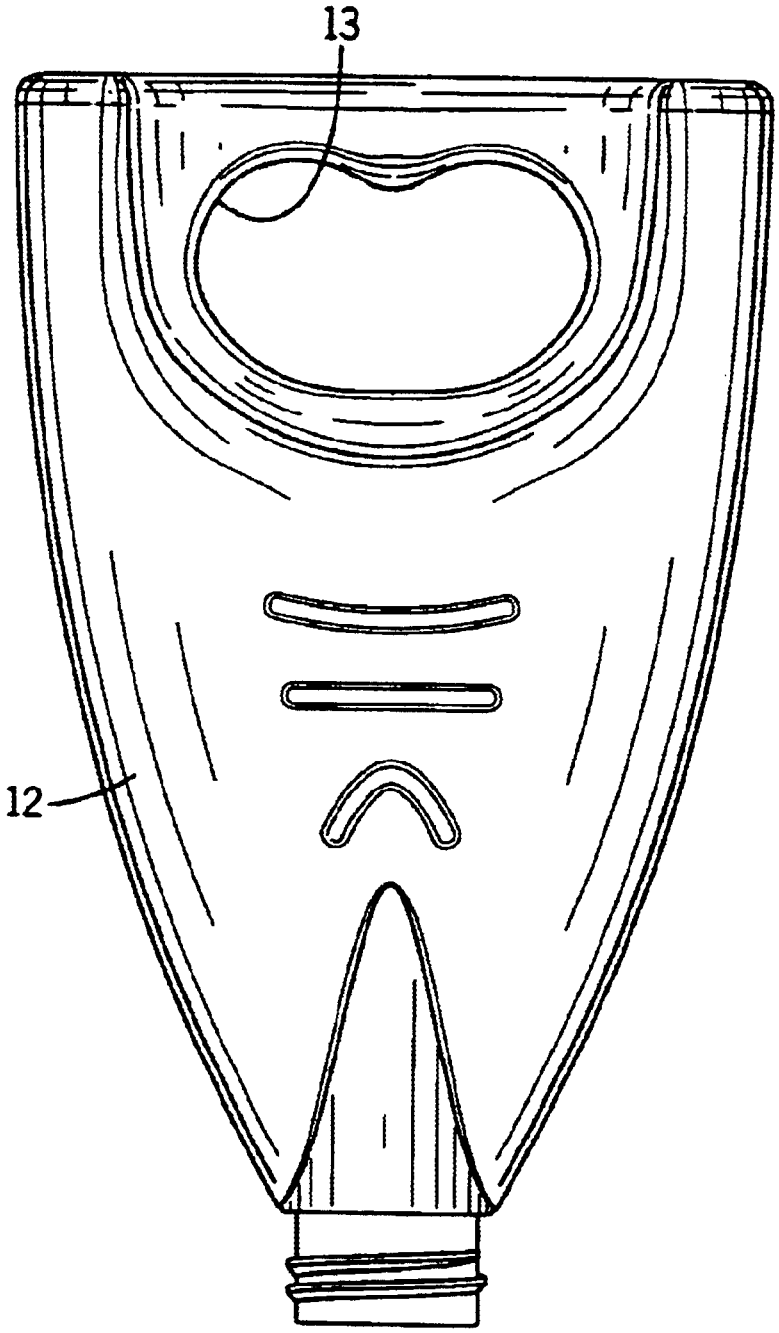
FIG. 5 is a front elevational, albeit upside down, view of the FIG. 1 bottle.

The bottle 12 is designed as a refill bottle that can be thrown away when emptied. As best seen in FIG. 5, through passageway 13 adjacent the bottom of the bottle is dual-lobed to be suitable for receiving two fingers of a human who is gripping the bottle. As seen in FIG. 1 and FIG. 4 the bottom of the bottle has a recess 60 to accommodate a storage position for hook 20.

Figure 3:
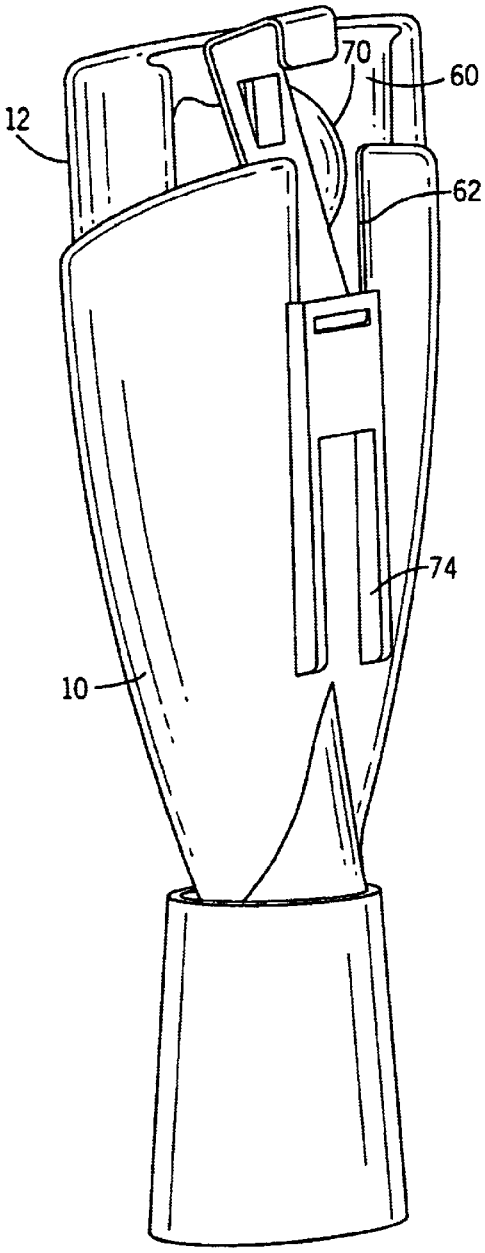
FIG. 3 is a rear perspective view of the FIG. 1 device.

The holster 10 is upwardly open at 61, and has, as shown in FIG. 3, a rear slot 62 extending vertically near the upper end. The interior of the holster is hollow, and it tapers in a configuration largely defined by the shape of the bottle downwardly to a cylindrical accumulation region.

Hook 20 is pivotally linked to a portion of the holster immediately below the slot 62. This may be achieved by a thin, horizontal web-type living hinge, or by other known hinge constructions. As seen in FIG. 4, the hook has an upwardly extending portion 63, an outwardly extending portion 64, a downward finger 65, and a flexible tooth 66. The tank wall (not shown) lodges within an essentially U-shaped cavity defined by the finger 65, outwardly extending portion 64, and the flexible tooth 66. The latter element flexes to correct for tank walls of different thickness. The hook also has lateral side prongs 70 (see especially FIG. 2) on its lower half.

As will be appreciated by examining FIG. 4, as the bottle 12 is pulled up out of the holster by a consumer from its purchased position (FIG. 1), a wide portion of the bottle 12 below the recess 60 contacts inside face of element 63, thereby automatically driving it outwardly relative to the rest of the holster, to essentially vertical alignment with the adjacent holster. The lateral prongs 70 of the hook are then driven outward of side walls of the slot 62 to snap engage the hook into a use position. If desired, the holster can also be provided with reinforcement ribs 74. See FIG. 3.

Thus, the hook is compactly stored for shipment to save space and to minimize the likelihood of breakage. Further, the consumer need not separately change the position of the hook apart from removing the bottle.

The dispenser is designed to work best if when the dispenser is mounted on the tank wall most of the dispenser is submerged when the tank is at its normal fill level, but the water level is still below the top of the holster. Importantly, the height of the holster insures a secure support for the bottle, while serving the dual purpose of preserving an air passageway to permit venting to the container as it empties.

By dispensing the product as the water level in the tank is falling, the amount of product that remains in the body of water in the bowl is maximized. This action provides better cleaning efficiency.

Figure 6:
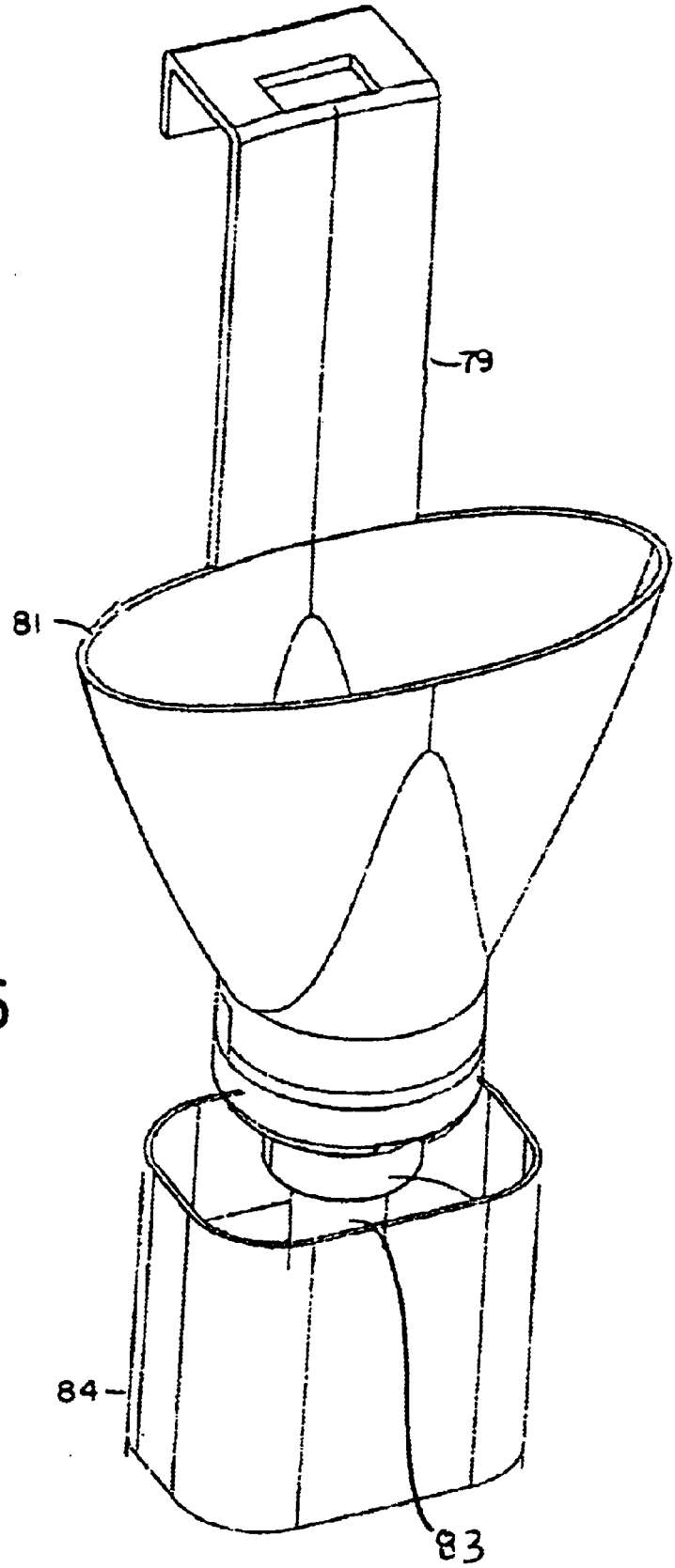
FIG. 6 is a left upper frontal perspective view of an alternative holster and flush structure embodying certain aspects of the present invention.

FIG. 6 shows an alternative embodiment suitable to be used with a container such as the FIG. 5 container (or other types of containers). It should be noted that the FIG. 5 container has side walls which slope towards the top of the container. Similarly, the holster 81 has internal side walls which are similarly sloped so that when the container is inserted in the holster 81 it will be guided and nested in a proper orientation.

Instead of a pivotable hook like that of hook 20 in FIG. 1, the FIG. 6 embodiment is provided with an integral hook 79 melded onto the upper edge of the holster 81. The holster is also linked at its lower end to a stem 83 upon which a control float 84 is mounted. In this configuration the float is more boxy (as distinguished from the more cylindrical structure in the FIG. 1 embodiment).

It should be appreciated that the embodiments discussed above are merely representative of the present invention and are provided for illustrative purposes only. They are not intended to limit the scope of the present invention. Various additional modifications are contemplated as being within the scope of the present invention. Thus, the claims should be looked to determine the full scope of the invention.

Industrial Applicability

The invention provides improved dispensers for dispensing desired chemicals into bodies of water having liquid levels that rise and fall, and specialized container bottles for use therewith.

We claim:

1. A dispenser for use in a tank that has a liquid level that rises and falls, the dispenser comprising:

a container housing a dispensable product and having a bottom, side walls, a top, an upper outlet, and an internal cavity; and an upwardly open holster for receiving the container with the container in an inverted position so that the upper outlet of the container is inside the holster, and so that a majority of the outside surface area of the side walls of the container is inside the holster; and a valve associated with the holster for controlling the dispensing of the dispensable product from the container in response to liquid level changes in the tank;

the valve having an air passage for permitting air to vent the container as the dispensable product is dispensed.

2. The dispenser of claim 1, wherein the valve has a piercing post extending upwardly, and the container has at least a portion of a pierceable membrane associated with the upper outlet of the container.

3. The dispenser of claim 1 wherein the liquid is water and the tank is a toilet tank.

4. A dispenser for use in a tank that has a liquid level that rises and falls, the dispenser comprising:

a container having a bottom, side walls, a top, an upper outlet, and a recess in a side wall adjacent the bottom;

an upwardly open holster for receiving the container with the container in an inverted position so that an upper outlet of the container is inside the holster; and a hook linked to the holster suitable to mount the dispenser on a tank wall such that the hook is pivotally mounted on an essentially horizontal axis to move from a first position overlying a portion of the container adjacent the recess to a second position outward of the container;

wherein upward movement of the container while removing the container from the holster can drive the hook from the first position to the second position.

5. The dispenser of claim 4 wherein the container contains a dispensable product.

6. The dispenser of claim 5, further comprising a valve associated with the holster for controlling the dispensing of the dispensable product from the container in response to liquid level changes in the tank.

7. The dispenser of claim 6 wherein the valve has an air passage for permitting air to vent the container as the dispensable product is dispensed.

8. The dispenser of claim 6, wherein the valve has a piercing post extending upwardly, and the container has at least a portion of a pierceable membrane associated with the upper outlet of the container.

9. The dispenser of claim 4 wherein the liquid is water and the tank is a toilet tank.

10. The dispenser of claim 4, wherein the hook has laterally projecting tabs, the holster has a slot adjacent the holster's upper end, and pivoting of the hook from the first position to the second position can drive the projecting tabs into snap engagement with sides of the slot.

11. A dispenser for use in a tank that has a liquid level that rises and falls, the dispenser comprising:

a container having a bottom, side walls, a top, an upper outlet, and an internal cavity, wherein the side walls upwardly slope towards each other; and an upwardly open holster for receiving the container with the container in an inverted position so that the upper outlet of the container is inside the holster, and so that a portion of the outside surface area of the side walls of the container is inside the holster, wherein internal walls of the holster are correspondingly sloped to receive a portion of the side walls of the container which slope towards each other in a nesting relationship;

wherein a lower portion of the holster is linked to a stem and a float is mounted on a radially outward portion of the stem.

12. The dispenser of claim 11 wherein a hook is integrally formed with the holster in a fashion suitable to permit the mounting of the holster on a toilet tank wall at a defined distance below the top of the tank wall.

13. A dispenser for use in a tank that has a liquid level that rises and falls, the dispenser comprising:

a container having a bottom, side walls, a top, an upper outlet, and an internal cavity, wherein the side walls upwardly slope towards each other; and an upwardly open holster for receiving the container with the container in an inverted position so that the upper outlet of the container is inside the holster, and so that a portion of the outside surface area of the side walls of the container is inside the holster, wherein internal walls of the holster are correspondingly sloped to receive a portion of the side walls of the container which slope towards each other in a nesting relationship;

wherein the container has a through passageway extending between said container side walls adjacent, but not at, the bottom of the container; and wherein the through passageway has at least two lobes to facilitate gripping of the container by two fingers extended through the container through passageway.

* * * * *